US007239092B2

(12) United States Patent
Mason

(10) Patent No.: US 7,239,092 B2
(45) Date of Patent: Jul. 3, 2007

(54) LIMITED OPEN CIRCUIT VOLTAGE BALLAST

(75) Inventor: Clinton H. Mason, Hanover Park, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 8 days.

(21) Appl. No.: 10/557,976

(22) PCT Filed: May 10, 2004

(86) PCT No.: PCT/IB2004/001588

§ 371 (c)(1),
(2), (4) Date: Nov. 17, 2005

(87) PCT Pub. No.: WO2004/103031

PCT Pub. Date: Nov. 26, 2004

(65) Prior Publication Data

US 2006/0261758 A1 Nov. 23, 2006

Related U.S. Application Data

(60) Provisional application No. 60/471,701, filed on May 19, 2003.

(51) Int. Cl.
*H05B 41/16* (2006.01)

(52) U.S. Cl. ..... 315/276; 315/278; 315/312

(58) Field of Classification Search ..... 315/57, 315/64, 70, 209 R, 210, 212, 219, 220, 224, 315/254, 255, 276, 277, 278, 291, 312
See application file for complete search history.

(56) References Cited

U.S. PATENT DOCUMENTS

| | | | | |
|---|---|---|---|---|
| 4,819,146 | A | 4/1989 | Nilssen | 363/98 |
| 4,902,942 | A * | 2/1990 | El-Hamamsy | 315/276 |
| 5,115,347 | A | 5/1992 | Nilssen | 315/247 |
| 5,117,158 | A * | 5/1992 | Arbel | 315/220 |
| 5,216,332 | A | 6/1993 | Nilssen | 315/224 |
| 5,270,618 | A | 12/1993 | Nilssen | 315/176 |
| 5,512,801 | A | 4/1996 | Nilssen | 315/209 R |
| 5,925,990 | A | 7/1999 | Crouse et al. | 315/307 |
| 6,072,282 | A * | 6/2000 | Adamson | 315/276 |
| 6,121,733 | A | 9/2000 | Nilssen | 315/224 |
| 6,181,085 | B1 | 1/2001 | Nilssen | 315/307 |
| 6,194,840 | B1 | 2/2001 | Chang | 315/209 R |
| 2003/0057866 | A1 * | 3/2003 | Takahashi et al. | 315/219 |
| 2003/0155873 | A1 * | 8/2003 | O'Meara | 315/312 |

* cited by examiner

*Primary Examiner*—Thuy V. Tran
*Assistant Examiner*—Tung Le

(57) ABSTRACT

A lighting system employs a pair of ballast input stages (21) operable to oscillate at different oscillating frequency (f1, f2) upon an initial powering of the ballast input stages (21). The lighting system further employs a pair of ballast output stages (23) for establishing an open circuit voltage across the ballast output stages (23) in response to an absence of a loading of lamps (10) across the ballast output stages (23). The light system further employ means for, subsequent to the initial powering of the ballast input stages (21) and in response to the absence of the loading of the lamps (10) across the ballast output stages (23), impending any parasitic loading across the ballast output stages (23) from phase locking the oscillating frequencies (f1, f2).

7 Claims, 5 Drawing Sheets

LIMITED OPEN CIRCUIT VOLTAGE BALLAST

CROSS REFERENCE TO RELATED APPLICATION

This application claims the benefit of U.S. provisional application Ser. No. 60/471,701, filed May 19, 2003, which is incorporated herein by reference.

The present invention generally relates to lamp ballasts. The present invention specifically relates to a limitation of an open circuit voltage of a plurality of ballast output stages connected in series.

FIG. 1 illustrates a known lamp ballast 20 for igniting and powering a pair of lamps 10. Ballast 20 has a ballast input stage 21 employing an oscillator 22 for driving a ballast output stage 23 having a known arrangement of a tank resonant capacitor C1, a current limiting capacitor C2, and a tank resonant transformer including a primary winding PW1 and secondary windings SW1–SW4. Typically, when lamps 10 are switched to a no-load condition (i.e., lamps 10 are switched out of ballast 20 or in a pre-ignition phase), an open circuit voltage across ballast output stage 23 complies with UL requirements. However, in some lighting applications, it is desirable to connect ballast output stages 23 of two or more lamp ballasts 20 in series to thereby power additional lamps 10. Thus, in dependence upon a topology of balance input stages 21, there may be need to limit an open circuit voltage across the series connection of ballast output stages 23 to ensure compliance with UL requirements and any other applicable safety standards.

The present invention provides an open circuit voltage limiting technique for a series connection of ballast output stages.

One form of the present invention is a lighting system employing a pair of ballast input stages operable to oscillate at different oscillating frequencies upon an initial powering of the ballast input stages. The lighting system further employs a pair of ballast output stages for establishing an open circuit voltage across the ballast output stages in response to an absence of a loading of lamps across the ballast output stages. The light system further employ means for, subsequent to the initial powering of the ballast input stages, impeding any parasitic loading across the ballast output stages from phase locking the oscillating frequencies in response to the absence of the loading of the lamps across the ballast output stages.

The foregoing form as well as other forms, features and advantages of the present invention will become further apparent from the following detailed description of the presently preferred embodiments, read in conjunction with the accompanying drawings.

The detailed description and drawings are merely illustrative of the present invention rather than limiting, the scope of the present invention being defined by the appended claims and equivalents thereof.

Figure 1:
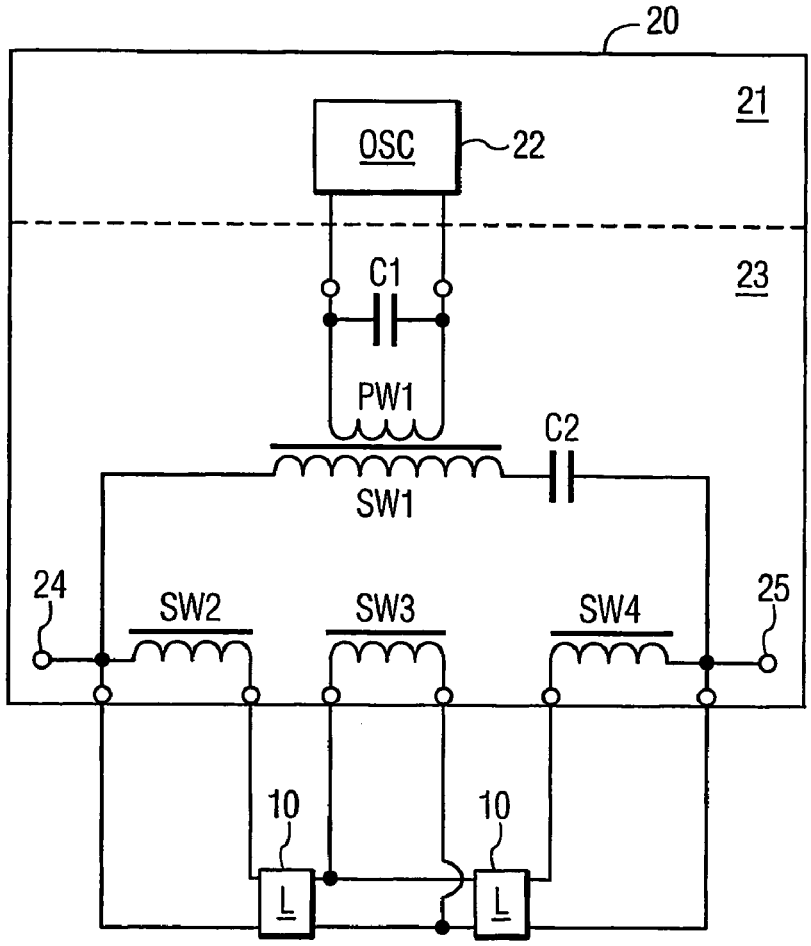
FIG. 1 PRIOR ART
FIG. 1 illustrates a lamp ballast known in the prior art.
Figure 2:
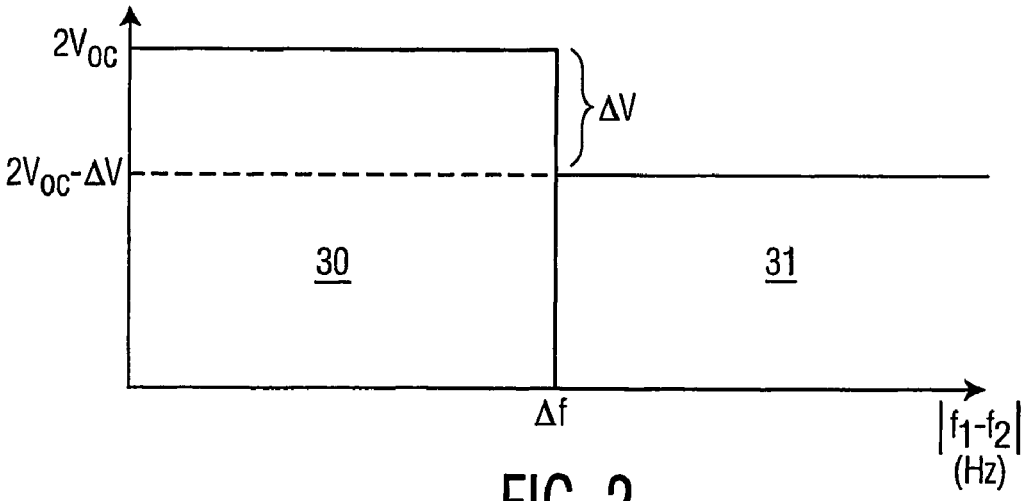
FIG. 2 illustrates a graphical representation of a voltage limiting technique of the present invention.

As illustrated in FIG. 2, the inventor discovered two distinct operation regions 30 and 31 of lamp ballasts 20 (FIG. 1) having a series connection of ballast output stages 23 (FIG. 1) due a sensitivity of oscillator 21 (FIG. 1) to parasitic loading. Operation regions 30 and 31 will subsequently be described in the context of a series connection of two (2) output ballast stages 23 to facilitate an understanding of operation regions 30 and 31. From this description, those having ordinary skill in the art will appreciate the how a series connection of three (3) output ballast stages 23 function in the operation regions 30 and 31.

Operation region 30 is defined by an absolute difference between an oscillating frequency $f_1$ and an oscillating frequency $f_2$ of a pair of ballast input stages 21 (FIG. 1) upon initial powering being within a range extending between 0 Hz to a cutoff frequency differential $\Delta f$. Within this operation region 30, a total rms of an open circuit voltage across the ballast output stages 23 during a no-load condition of the lamps is an open circuit voltage $V_{OC}$ supplied individually by the ballast output stages 23. From the investigation, the inventor ascertained that the total rms $2V_{OC}$ of the open circuit voltage within operation region 30 resulted from a leakage current from a parasitic loading of the output leads 24, 25 of the series connected ballast output stages 23 would force a phase lock of oscillating frequency $f_1$ and oscillating frequency $f_2$.

Operation region 31 is defined by the absolute difference between oscillating frequency $f_1$ and oscillating frequency $f_2$ of a pair of ballast input stages 21 (FIG. 1) upon initial powering being greater than the cutoff frequency differential $\Delta f$. Within this operation region 31, total rms of an open circuit voltage across the ballast output stages 23 during a no-load condition of the lamps is less than the open circuit voltage $2V_{OC}$ by a voltage differential $\Delta V$. From the investigation, the inventor ascertained that the total rms $2V_{OC}-\Delta V$ of the open circuit voltage within operation region 31 resulted from the leakage current from the parasitic loading of the output leads 24, 25 of the series connected ballast output stages 23 being unable to force a phase lock of oscillating frequency $f_1$ and oscillating frequency $f_2$.

It is advantageous to operate the lamp ballasts in region 31 whenever the total rms $2V_{OC}$ of region 30 exceeds UL requirements and total rms $2V_{OC}-\Delta V$ of region 31 is below UL requirements. Thus, the inventor of the present invention performed a considerable amount of investigation into discovering a technique for eliminating the cutoff frequency differential $\Delta f$ to thereby limit the open circuit voltage across a series connection of ballast output stages 23 under any topology of ballast input stages 21. To this end, FIGS. 3–6 illustrate various embodiments for implementing the open circuit voltage limiting technique of the present invention for series connected ballast output stages 23.

Figure 3:
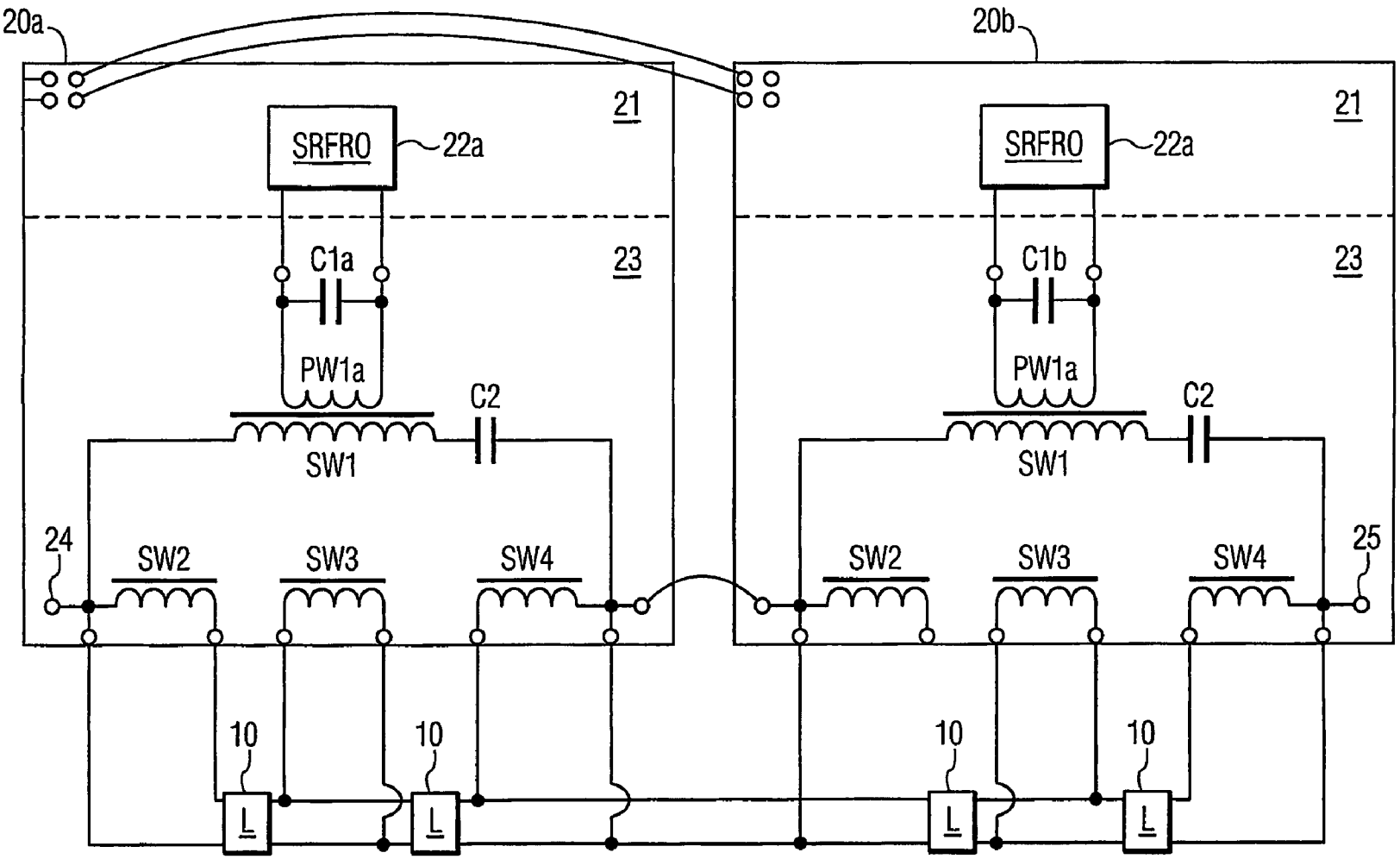
FIG. 3 illustrates a series connection of lamp ballasts in accordance with a first embodiment of the present invention.

FIG. 3 illustrates a version 20*a* and a version 20*b* of lamp ballast 20 (FIG. 1) for powering four lamps 10. Lamp ballasts 20*a* and 20*b* have their ballast input stages 21 coupled in parallel and their ballast output stages 23 coupled in series. Ballast input stages 21 employ a pair of self-resonating, free-running oscillators ("SRFRO") 22*a* of any type having an absolute oscillating frequency differential greater than zero (0) upon an initial powering of oscillators 22*a*. To maintain this absolute oscillating frequency differential between oscillators 22*a* subsequent to the powering of oscillators 22*a*, ballast output stage 23 of lamp ballast 20*a* employs a tank resonant capacitor C1*a* and ballast output stage 23 of lamp ballast 20*b* employs a tank resonant capacitor C1*b*. A capacitive differential between capacitors C1*a* and C1*b* is chosen to impede any parasitic loading across ballast output stages 23 during a no-load condition of lamps 10 from phase locking the oscillating frequencies of ballast input stages 21.

In practice, the capacitive differential between capacitors C1*a* and C1*b* is dependent upon the sensitivity of oscillators 22*a* to the parasitic loading. Thus, the inventor is incapable of describing a preferred capacitance differential between capacitors C1*a* and C1*b* due to the essentially unlimited number of topologies of oscillators 22*a* as would be appreciated by those having ordinary skill in the art However, for each topology of oscillators 22*a*, a minimal capacitance differential between capacitors C1*a* and C1*b* can be ascertained by the generation of a beat frequency waveform at no load that shows the oscillating frequencies are not phase locked as would be appreciated by those having ordinary skill in the art.

Figure 4:
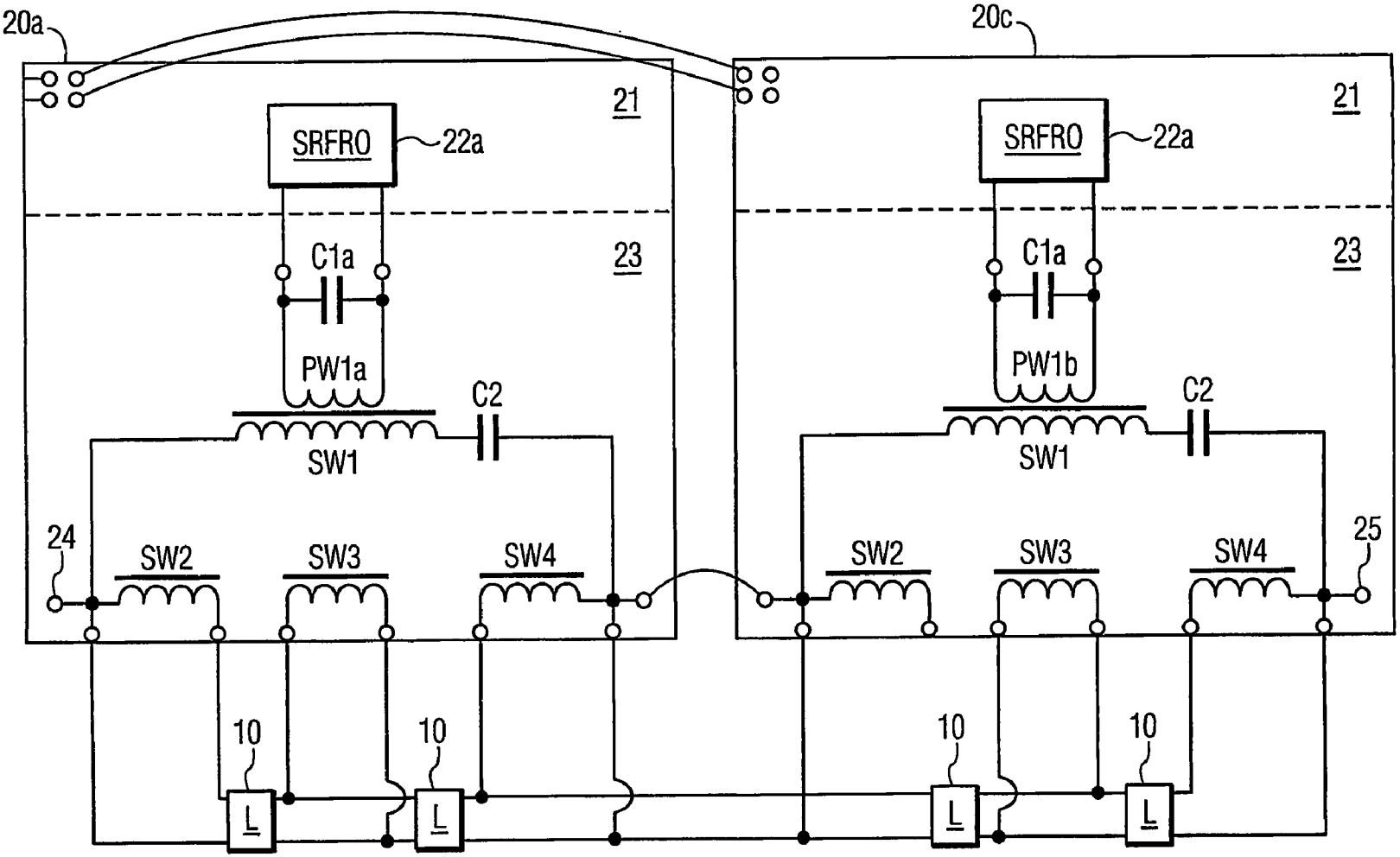
FIG. 4 illustrates a series connection of lamp ballasts in accordance with a second embodiment of the present invention.

FIG. 4 illustrates version 20*a* and a version 20*c* of lamp ballast 20 (FIG. 1) for powering four lamps 10. Lamp ballasts 20*a* and 20*c* have their ballast input stages 21 coupled in parallel and their ballast output stages 23 coupled in series. Ballast input stages 21 employ a pair of self-resonating, free-running oscillators ("SRFRO") 22*a* of any type having an absolute oscillating frequency differential greater than zero (0) upon an initial powering of oscillators 22*a*. To maintain this absolute oscillating frequency differential between oscillators 22*a* subsequent to the powering of oscillators 22*a*, ballast output stage 23 of lamp ballast 20*a* employs a primary winding PW1*a* and ballast output stage 23 of lamp ballast 20*b* employs a primary winding PW1*b*. A inductive differential between primary windings PW1*a* and PW1*b* is chosen to impede any parasitic loading across ballast output stages 23 during a no-load condition of lamps 10 from phase locking the oscillating frequencies of ballast input stages 21.

In practice, the inductive differential between PW1*a* and PW1*b* is dependent upon the sensitivity of oscillators 22*a* to the parasitic loading. Thus, the inventor is incapable of describing a preferred inductance differential between PW1*a* and PW1*b* due to the essentially unlimited number of topologies of oscillators 22*a* as would be appreciated by those having ordinary skill in the art. However, for each topology of oscillators 22*a*, a minimal inductance differential between PW1*a* and PW1*b* can be ascertained by the generation of a beat frequency waveform at no load that shows the oscillating frequencies are not phase locked as would be appreciated by those having ordinary skill in the art.

Figure 5:
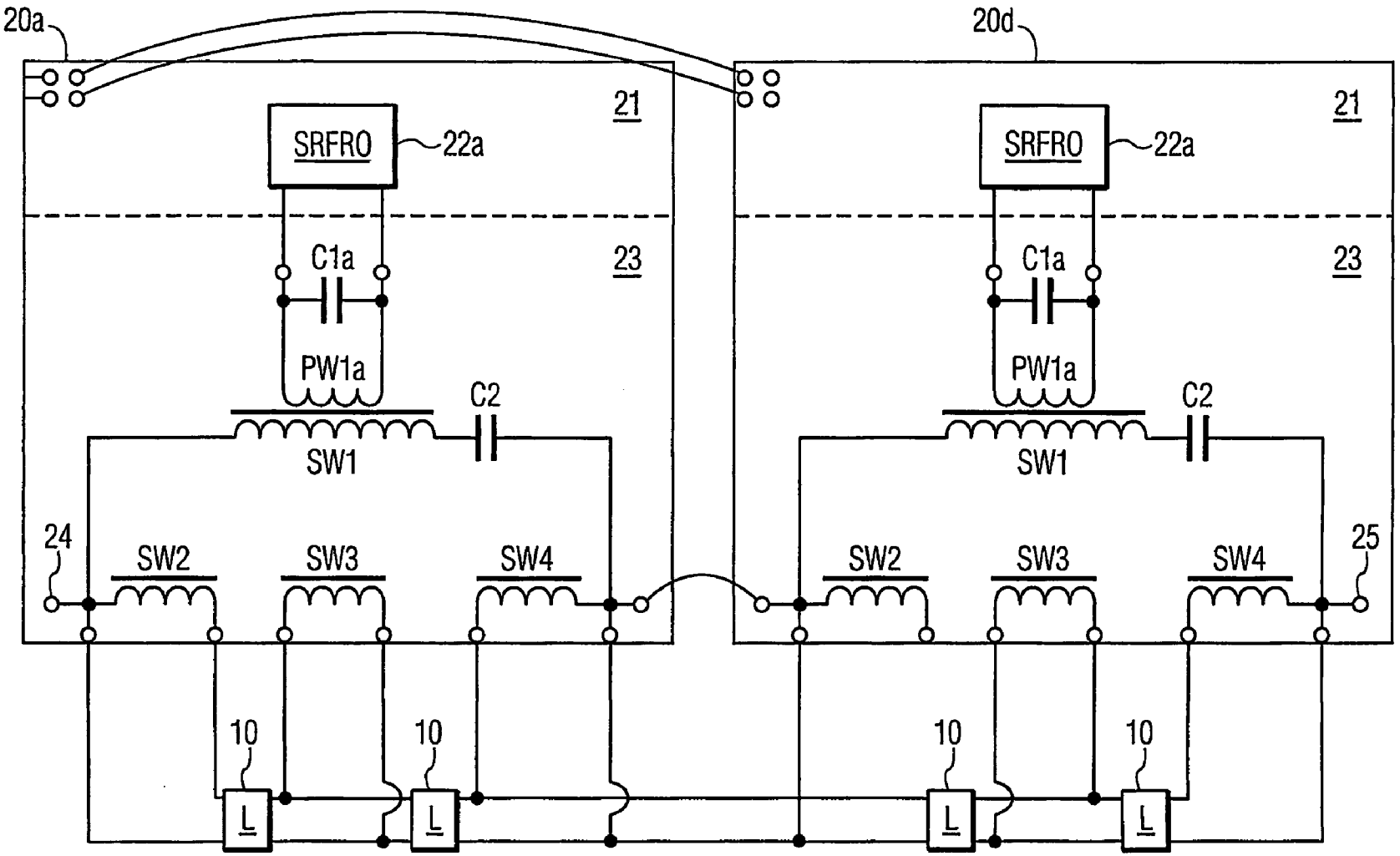
FIG. 5 illustrates a series connection of lamp ballasts in accordance with a third embodiment of the present invention.

FIG. 5 illustrates version 20*a* and a version 20*d* of lamp ballast 20 (FIG. 1) for powering four lamps 10. Lamp ballasts 20*a* and 20*d* have their ballast input stages 21 coupled in parallel and their ballast output stages 23 coupled in series. Ballast input stages 21 employ a pair of self-resonating, free-running oscillators ("SRFRO") 22*a* of any type having an absolute oscillating frequency differential greater than zero (0) upon an initial powering of oscillators 22*a*. To maintain this absolute oscillating frequency differential between oscillators 22*a* subsequent to the powering of oscillators 22*a*, an air gap between primary winding PW1*a* and secondary windings SW1–SW4 of lamp ballast 20*a* is less than the air gap between primary winding PW1*a* and secondary windings SW1–SW4 of lamp ballast 20*d*. A air gap differential between resonant transformers is chosen to impede any parasitic loading across ballast output stages 23 during a no-load condition of lamps 10 from phase locking the oscillating frequencies of ballast input stages 21.

In practice, the air gap differential between the resonant transformers is dependent upon the sensitivity of oscillators 22*a* to the parasitic loading. Thus, the inventor is incapable of describing a preferred air gap differential between the resonant transformers due to the essentially unlimited number of topologies of oscillators 22*a* as would be appreciated by those having ordinary skill in the art. However, for each topology of oscillators 22*a*, a minimal air gap differential between the resonant transformers can be ascertained by the generation of a beat frequency waveform at no load that shows the oscillating frequencies are not phase locked as would be appreciated by those having ordinary skill in the art.

Figure 6:
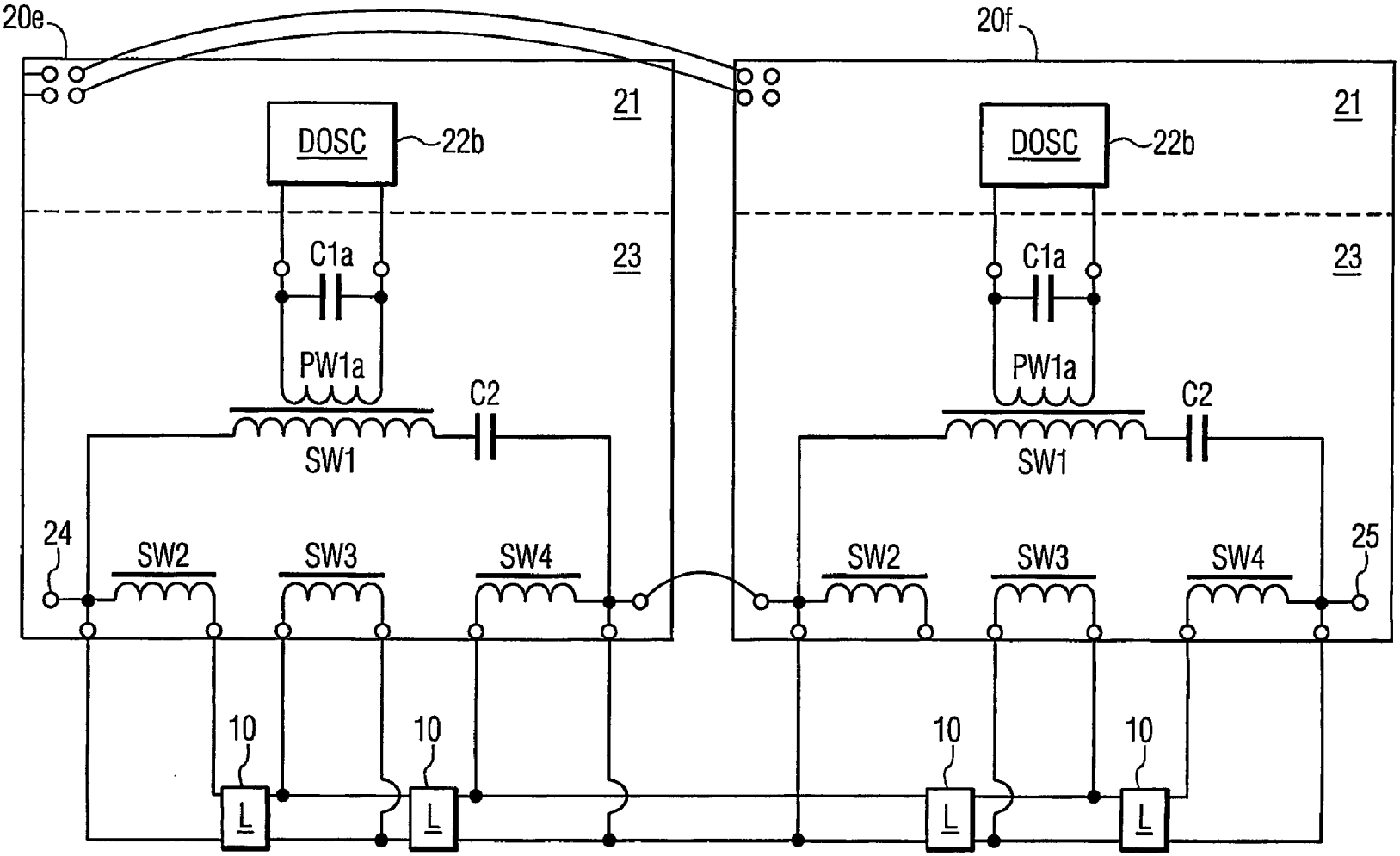
FIG. 6 illustrates a series connection of lamp ballasts in accordance with a fourth embodiment of the present invention.

FIG. 6 illustrates a version 20*e* and a version 20*f* of lamp ballast 20 (FIG. 1) for powering four lamps 10. Lamp ballasts 20*e* and 20*f* have their input stages 21 coupled in parallel and their output stages 23 coupled in series. Lamp ballasts 20*ae* and 20*f* both employ a digitally controlled oscillator ("DSCO") 22*b* of any type. The oscillators 22*b* are programmed to maintain an oscillating frequency differential between the oscillators 22*b* upon and subsequent to the powering of ballast input stages 21. The oscillating frequency differential is chosen to impede any parasitic loading across ballast output stages 23 during a no-load condition of lamps 10 from phase locking the oscillating frequencies of ballast input stages 21.

In practice, the oscillating frequency differential is dependent upon the sensitivity of oscillators 22*b* to the parasitic loading. Thus, the inventor is incapable of describing a preferred oscillating frequency differential due to the essentially unlimited number of topologies of oscillators 22*b* as would be appreciated by those having ordinary skill in the art. However, for each topology of oscillators 22*b*, a minimal oscillating frequency differential can be ascertained by the generation of a beat frequency waveform at no load that shows the oscillating frequencies are not phase locked as would be appreciated by those having ordinary skill in the art.

While the embodiments of the invention disclosed herein are presently considered to be preferred, various changes and modifications can be made without departing from the spirit and scope of the invention. For example, any combination of open circuit voltage limiting techniques illustrated in FIGS. 3–6 can be implemented in practice. The scope of the invention is therefore indicated in the appended claims, and all changes that come within the meaning and range of equivalents are intended to be embraced therein.

The invention claimed is:

1. A lighting system, comprising:

a first ballast input stage (21) and a second ballast input stage (21), said first ballast input stage (21) operable to oscillate at a first oscillating frequency ($f_1$) and said second ballast input stage (21) operable to oscillate at a second oscillating frequency ($f_2$), the first oscillating frequency ($f_1$) and the second oscillating frequency ($f_1$) being dissimilar upon an initial powering of said first ballast input stage (21) and said second ballast input stage (21);

a first ballast output stage (23) and a second ballast output stage (23) connected in series, said first ballast output stage (23) in electrical communication with said first ballast stage (21) and said second ballast output stage (23) in electrical communication with said second ballast stage (21) to establish an open circuit voltage across said first ballast output stage (23) and said second ballast output stage (23) in response to an absence of a loading of a plurality of lamps (10) across said first ballast output stage (23) and said second ballast output stage (23); and means for, subsequent to the initial powering of said first ballast input stage (21) and said second ballast input stage (21) and in response to the absence of the loading of the plurality of lamps (10) across said first ballast output stage (23) and said second ballast output stage (23), impeding any parasitic loading across said first ballast output stage (23) and said second ballast output stage (23) from phase locking the first oscillating frequency ($f_1$) and the second oscillating frequency ($f_2$).

2. A lighting system, comprising:

a plurality of ballast input stages (21) operable to oscillate at various oscillating frequencies ($f_1$,$f_2$), the oscillating frequencies ($f_1$,$f_2$) being dissimilar upon an initial powering of said plurality of ballast input stages (21);

a plurality of ballast output stages (23) connected in series, said plurality of ballast output stages (23) is in electrical communication with said plurality of ballast input stages (21) to establish an open circuit voltage across said plurality of ballast output stages (23) in response to an absence of a loading of a plurality of lamps (10) across said plurality of ballast output stages (23); and means for, subsequent to the initial powering of said plurality of ballast input stages (21) and in response to the absence of the loading of the plurality of lamps (10) across said plurality of ballast output stages (23), impeding any parasitic loading across said plurality of ballast output stages (23) from phase locking the oscillating frequencies ($f_1$,$f_2$).

3. A lighting system, comprising:

a first ballast input stage (21) and a second ballast input stage (21), said first ballast input stage (21) operable to oscillate at a first oscillating frequency ($f_1$) and said second ballast input stage (21) operable to oscillate at a second oscillating frequency ($f_2$), the first oscillating frequency ($f_1$) and the second oscillating frequency ($f_1$) being dissimilar upon an initial powering of said first ballast input stage (21) and said second ballast input stage (21);

a first ballast output stage (23) and a second ballast output stage (23) connected in series, said first ballast output stage (23) in electrical communication with said first ballast stage (21) and said second ballast output stage (23) in electrical communication with said second ballast stage (21) to establish an open circuit voltage across said first ballast output stage (23) and said second ballast output stage (23) in response to an absence of a loading of a plurality of lamps (10) across said first ballast output stage (23) and said second ballast output stage (23), wherein, subsequent to the initial powering of said first ballast input stage (21) and said second ballast input stage (21) and in response to the absence of the loading of the plurality of lamps (10) across said first ballast output stage (23) and said second ballast output stage (23), said first ballast output stage (23) and said second ballast output stage (23) impede any parasitic loading across said first ballast output stage (23) and said second ballast output stage (23) from phase locking the first oscillating frequency ($f_1$) and the second oscillating frequency ($f_2$).

4. The lighting system of claim 3, wherein said first ballast output stage (23) includes a first tank resonant capacitor (C1*a*);

wherein said second ballast output stage (23) includes a second tank resonant capacitor (C1*b*); and wherein, subsequent to the initial powering of said first ballast input stage (21) and said second ballast input stage (21) and in response to the absence of the loading of the plurality of lamps (10) across said first ballast output stage (23) and said second ballast output stage (23), a capacitive differential between said first tank resonant capacitor (C1*a*) and said second tank resonant capacitor (C1*b*) impedes any parasitic loading across said first ballast output stage (23) and said second ballast output stage (23) from phase locking the first oscillating frequency ($f_1$) and the second oscillating frequency ($f_2$).

5. The lighting system of claim 3, wherein said first ballast output stage (23) includes a first primary winding (PW1*a*);

wherein said second ballast output stage (23) includes a second primary winding (PW1*b*); and wherein, subsequent to the initial powering of said first ballast input stage (21) and said second ballast input stage (21) and in response to the absence of the loading of the plurality of lamps (10) across said first ballast output stage (23) and said second ballast output stage (23), an inductive differential between said first primary winding (PW1*a*) and said second primary winding (PW1*b*) impedes any parasitic loading across said first ballast output stage (23) and said second ballast output stage (23) from phase locking the first oscillating frequency ($f_1$) and the second oscillating frequency ($f_2$).

6. The lighting system of claim 3, wherein said first ballast output stage (23) includes a first primary winding (PW1*a*) and a first at least one secondary winding (SW1–SW4) spaced from said first primary winding (PW1*a*) by a first air gap;

wherein said second ballast output stage (23) includes a second primary winding (PW1*b*) and a second at least one secondary winding (SW1–SW4) spaced from said first primary winding (PW1*a*) by a second air gap; and wherein, subsequent to the initial powering of said first ballast input stage (21) and said second ballast input stage (21) and in response to the absence of the loading of the plurality of lamps (10) across said first ballast output stage (23) and said second ballast output stage (23), a differential between the first air gap and the second air gap impedes any parasitic loading across said first ballast output stage (23) and said second ballast output stage (23) from phase locking the first oscillating frequency ($f_1$) and the second oscillating frequency ($f_2$).

7. The lighting system of claim 3, wherein said first ballast output stage (23) includes a first oscillator (22*b*) operating at the first oscillating frequency ($f_1$);

wherein said second ballast output stage (23) a second oscillator (22*b*) operating at the second oscillating frequency ($f_2$); and wherein, subsequent to the initial powering of said first ballast input stage (21) and said second ballast input stage (21) and in response to the absence of the loading of the plurality of lamps (10) across said first ballast output stage (23) and said second ballast output stage (23), a differential between the first oscillating frequency ($f_1$) and the second oscillating frequency ($f_2$) is maintained by said first oscillator (22*b*) and said second oscillator (22*b*) to impede any parasitic loading across said first ballast output stage (23) and said second ballast output stage (23) from phase locking the first oscillating frequency ($f_1$) and the second oscillating frequency ($f_2$).

* * * * *